US006412674B1

(12) United States Patent
Lipke

(10) Patent No.: US 6,412,674 B1
(45) Date of Patent: Jul. 2, 2002

(54) ADJUSTABLE POCKET

(75) Inventor: Richard A. Lipke, Bellingham, WA (US)

(73) Assignee: Conterra, Inc., Bellingham, WA (US)

( * ) Notice: Subject to any disclaimer, the term of this patent is extended or adjusted under 35 U.S.C. 154(b) by 0 days.

(21) Appl. No.: 09/684,352

(22) Filed: Oct. 6, 2000

Related U.S. Application Data

(60) Provisional application No. 60/158,293, filed on Oct. 8, 1999.

(51) Int. Cl.[7] ..... A45F 3/00

(52) U.S. Cl. ..... 224/240; 224/235; 224/675; 224/676; 224/930

(58) Field of Search ..... 224/235, 236, 224/238, 240, 901.2, 901.4, 901.8, 904, 911, 930, 675, 676

(56) References Cited

U.S. PATENT DOCUMENTS

| | | | | | |
|---|---|---|---|---|---|
| 4,479,596 | A | * | 10/1984 | Swanson | 224/236 |
| 5,511,702 | A | * | 4/1996 | Yang | 224/219 |
| 5,653,367 | A | * | 8/1997 | Abramson | 224/581 |
| 5,957,357 | A | | 9/1999 | Kallman | |
| 6,056,174 | A | * | 5/2000 | Minckler | 224/250 |
| 6,109,496 | A | * | 8/2000 | Andrew et al. | 224/664 |
| 6,202,908 | B1 | * | 3/2001 | Groover | 224/239 |

OTHER PUBLICATIONS

Drawing, "Conterra" prior art (Exhibit A), undated.
Drawing, "Cascade Tobaggan" prior art (Exhibit B), undated.
Drawing, "Motorola & others" prior art (Exhibit C), undated.

* cited by examiner

*Primary Examiner*—Stephen K. Cronin
(74) *Attorney, Agent, or Firm*—Michael R. Schacht; Schacht Law Office, Inc.

(57) ABSTRACT

An adjustable pocket comprising a pocket chamber and a strap assembly comprising a strap member, a first fastener, and a second fastener. The pocket chamber is adapted to contain equipment such as portable communications devices. The pocket chamber is defined by a front wall, a rear wall having at least one hole formed therein, a bottom wall, a first side wall, and a second side wall. The strap member has first and second ends. The first fastener fastens the strap member first end to the front wall. The second fastener fastens the strap member second end to the rear wall. The strap member extends through the hole in the rear wall such that the second fastener fastens the strap member second end to an outer surface of the rear wall. The second fastener is preferably a hook and loop fastener that allows infinite fine adjustment of the form factor defined by the adjustable pocket. A plurality of holes are preferably formed in the rear wall to allow discrete gross adjustment of the form factor defined by the adjustable pocket.

39 Claims, 2 Drawing Sheets

ADJUSTABLE POCKET

RELATED APPLICATIONS

This application claims priority of U.S. Provisional Patent Application Ser. No. 60/158,293, which was filed on Oct. 8, 1999.

TECHNICAL FIELD

The present invention relates to systems and methods for carrying portable electronic devices and, more specifically, to carrying systems and methods that may be adjusted to accommodate electronic devices of different sizes.

BACKGROUND OF THE INVENTION

The present invention has particular significance to carrying systems and methods for portable electronic equipment, and that application of the present invention will be discussed in detail herein. However, the present invention may have broader application to carrying systems for other types of equipment. The scope of the present invention should thus be determined by the claims appended hereto and not the following discussion of the background or the preferred embodiment for carrying out the present invention.

Electronic equipment is constantly being made smaller and more portable. Stereo equipment, computers, and, perhaps most importantly, communications equipment are all made in small, lightweight, energy efficient versions, powered by batteries, and carried with the user.

Various holsters, pouches, pockets, bags, and the like have been developed to carry portable electronic equipment. A major class of such carrying systems is holster or sheath tailored specifically for a given portable device. The holster is typically clipped onto or looped around the user's belt or other article of clothing at a convenient location. The holster typically comprises a strap secured at one end to the holster and detachably attached at the other end to the holster such that the strap holds the equipment in place. In the case of communications equipment such as telephones, pagers, or two-way radios, the strap is detached to allow the equipment to be removed for viewing and/or answering.

Tailored carrying systems are often acceptable but may not be appropriate in many situations. For example, a uniform may preclude the use of a unique, tailored carrying system. As another example, an activity such as fire fighting, search and rescue, or the like may not be compatible with conventional tailored holsters that are clipped or looped around a user's belt or waist band.

As new portable electronic equipment is introduced, the new equipment is generally smaller and lighter than earlier versions; a tailored carrying system made for one type of equipment may not securely hold another type of equipment.

Conventional tailored carrying systems are also difficult to integrate with larger carrying systems. For example, a chest harness may be designed with an integral pocket for carrying communications equipment. This pocket must be large enough for the largest equipment that can be available and thus may be too large for the smallest equipment available. The entire chest harness may need to be replaced at significant expense as the communications equipment is changed.

In addition, in some situations the communications equipment carried by the user may change depending upon the circumstances. For example, a user may carry a portable telephone in a city environment but switch to a two-way radio in environments without reliable cellular service. The user may need to purchase and carry two different tailored carrying devices, and may have problems with more comprehensive carrying systems sized to carry only one size of communications equipment.

Some equipment pockets have been made to accommodate thinner or narrower equipment by providing straps that, in essence, allow the side panels to be shortened or collapsed.

A number of attempts have been made to provide height adjustment. In one system, a series of loops are sewn to the back wall extending in the height direction. A cord is threaded through one of the loops and then tied to a length appropriate to contain the device in the pocket. A snap fastener is formed on the end of the cord away from the back wall to attach the cord to the pocket front wall over the pocket opening. In another system, a cord is sewn at its upper end to the pocket rear wall. The end of the cord away from the fixed end is attached using velcro that allows a only very limited amount of adjustability of the pocket height. Yet another system using a strap that extends is passed through a sandwich of velcro such that ends of the strap extend around a side of the device in the pocket. The sandwich of velcro holds the strap in the desired place. The strap can be moved up and down relative to the pocket chamber but does not cover the top of the chamber.

Accordingly, the need exists for systems and methods for carrying equipment, such as portable electronics equipment, that may be altered in size to accommodate equipment of different sizes, shapes, and weights. In addition, the need exists for such systems and methods that can be manufactured of conventional materials using conventional manufacturing equipment. Also, such systems and methods should be appropriate for use as a stand-alone carrying system or for integration into a larger carrying system.

SUMMARY OF THE INVENTION

The present invention is, in one preferred form, an adjustable pocket comprising a pocket chamber and a strap assembly comprising a strap member, a first fastener, and a second fastener. The pocket chamber is adapted to contain equipment such as portable communications devices. The pocket chamber is defined by a front wall, a rear wall having at least one hole formed therein, a bottom wall, a first side wall, and a second side wall. The strap member has first and second ends. The first fastener fastens the strap member first end to the front wall. The second fastener fastens the strap member second end to the rear wall. The strap member extends through the hole in the rear wall such that the second fastener fastens the strap member second end to an outer surface of the rear wall. The second fastener is preferably a hook and loop fastener that allows infinite fine adjustment of the form factor defined by the adjustable pocket. A plurality of holes are preferably formed in the rear wall to allow discrete gross adjustment of the form factor defined by the adjustable pocket.

In another form, the present invention is a method of forming an adjustable pocket. The preferred method comprising the steps of providing a front wall, a rear wall having at least one hole formed therein, a bottom wall, a first side wall, and a second side wall; arranging the front wall, rear wall, bottom wall, first side wall, and second side wall to define a pocket chamber; providing a strap assembly comprising a strap member having first and second ends, a first fastener, and a second fastener; extending the strap member through the at least one hole in the rear wall such that the second fastener fastens the strap member second end to an outer surface of the rear wall to define a first form factor; and operating the first fastener to fasten the strap member first end to the front wall.

The present invention in various forms obtains at least some of the objects of the invention described above.

DETAILED DESCRIPTION OF THE INVENTION

Figures 1, 2:
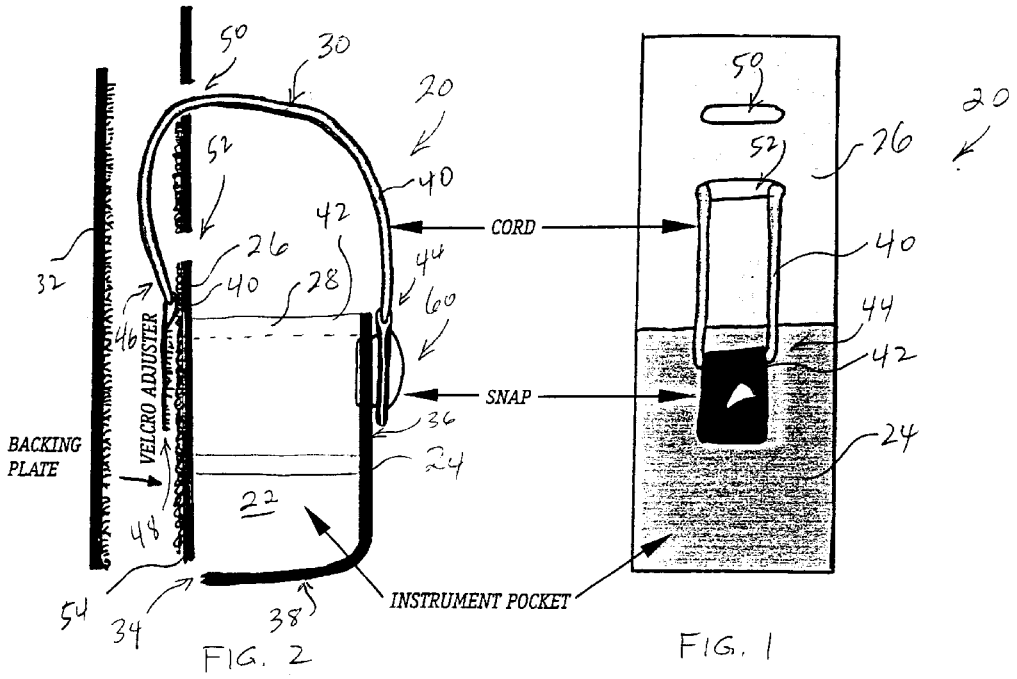
FIG. 1 is a front elevation view of an adjustable pocket system constructed in accordance with, and embodying, the principles of the present invention.
FIG. 2 is a side elevation, partial section view of the adjustable pocket system of FIG. 1.

Referring initially to FIGS. 1 and 2, depicted at 20 therein is an adjustable pocket system constructed in accordance with, and embodying, the principles of the present invention. The system 20 will initially be described below in a generic form. However, the adjustable pocket system 20 will normally be embodied as part of a carrying system and may be implemented in a variety of configurations. Accordingly, following the general description of the adjustable pocket system 20, two common carrying systems in which the system 20 may be incorporated will be discussed.

I. Adjustable Pocket System

The adjustable pocket system 20 defines a pocket chamber 22 for carrying equipment and perhaps most importantly for carrying a portable electronic device such as a two-way radio, cellular telephone, locator, or the like. More particularly, the pocket system 20 comprises a front panel 24, a rear panel 26, first and second side panels 28 (only one shown in FIG. 2), and a strap member 30. Preferably, the pocket system 20 further comprises a backing panel 32.

The front panel 24 and rear panel 26 may, but need not, be integrally formed from one piece of fabric. Accordingly, a gap 34 in FIG. 2 schematically indicates that the front panel 24 may be formed separately from the rear panel 26.

The front panel 24 forms a front wall 36 and bottom wall 38 that define the pocket chamber 22. The rear panel 26 defines a rear wall 40. The side panels 28 define first and second side walls 42 (again, only one is shown in FIG. 2). These walls 36–42 substantially, but not necessarily entirely, enclose five sides of the pocket chamber 22.

An upper side of the pocket chamber 22 is generally open, but the strap member 30 may be secured over this upper side of the pocket chamber 22 to prevent devices within the chamber 22 from falling out should the pocket system 20 be bumped or inverted.

In particular, the exemplary strap member 30 comprises a loop 40 and a strap panel 42. Attached to the strap panel 42 is one-half of a button assembly that may be used to securely attach an outer end 44 of the loop 40 to the front panel 24.

An inner end 46 of the loop 40 is attached to an inner strap panel 48. First and second strap openings 50 and 52 are formed in the rear panel 26 at different locations spaced above the pocket chamber 22. The inner end 46 of the loop 40 is adjustably attached to an outer surface 54 of the rear panel 26. In particular, a hook and loop fastener 56 is formed on the inner panel 48 and rear panel 26 that allows the loop end 46 to be temporarily attached at a desired location on the outer surface 54 of the rear panel 26. In particular, the hook portion of the fastener 56 is attached to one of the outer surface 54 of the rear panel 26 or to the inner panel 48, while the loop portion is attached to the other of the surface 54 and the inner panel 48. Fasteners other than a hook and loop fastener may be used, but the hook and loop fastener is relatively thin, requires no bulky parts, and is infinitely adjustable.

The backing panel 32 also has one of the appropriate hook and loop fasteners formed thereon such that it too is detachably attached to the outer surface 54 of the rear panel 26.

The strap member 30 may be made of other materials in other configurations, but the loop 40 described herein is desirable because it does not interfere with the operation of the elements (antennas, cables, etc.) of the equipment contained in the pocket chamber 22.

The system 20 described above allows the pocket chamber 22 to be configured to securely contain both short and tall portable electronic devices. For a tall portable electronic device, the loop 40 is passed through the uppermost strap opening 50 and the hook and loop fastener is used to attached the inner end 46 of the loop 40 to a location on the rear panel 26 that allows the strap 30 to snugly accommodate the electronic device.

For shorter electronic devices, the loop 40 is passed through the lowermost strap opening 52. The inner end 46 of the loop 40 will be connected most likely at a lower location, to the rear panel 26. When the button assembly 60 is used to attach the outer end 44 of the loop portion 40 to the front panel 24, even this shorter electronic device will be snugly held within the pocket chamber 22.

The strap member 30, in combination with the pocket chamber 22, thus defines a form factor for the pocket system 20 that can be adjusted as desired to accommodate equipment of different sizes.

The backing panel 32, when attached to the rear panel 26 by the hook and loop fasteners thereon, will frictionally engage the inner end 46 of the loop portion 40 and the inner panel 48 to help prevent movement of the end 46 should the pocket system 20 be bumped, jarred, or inverted. The backing panel 32 is not essential to any implementation of the present invention but secures and protects the inner end 46.

The adjustable pocket system 20 will thus snugly hold a portable electronic device in the pocket chamber 22 and can be adjusted to accommodate devices of different heights.

II. Device Holster

Figures 3, 4, 5, 5A:
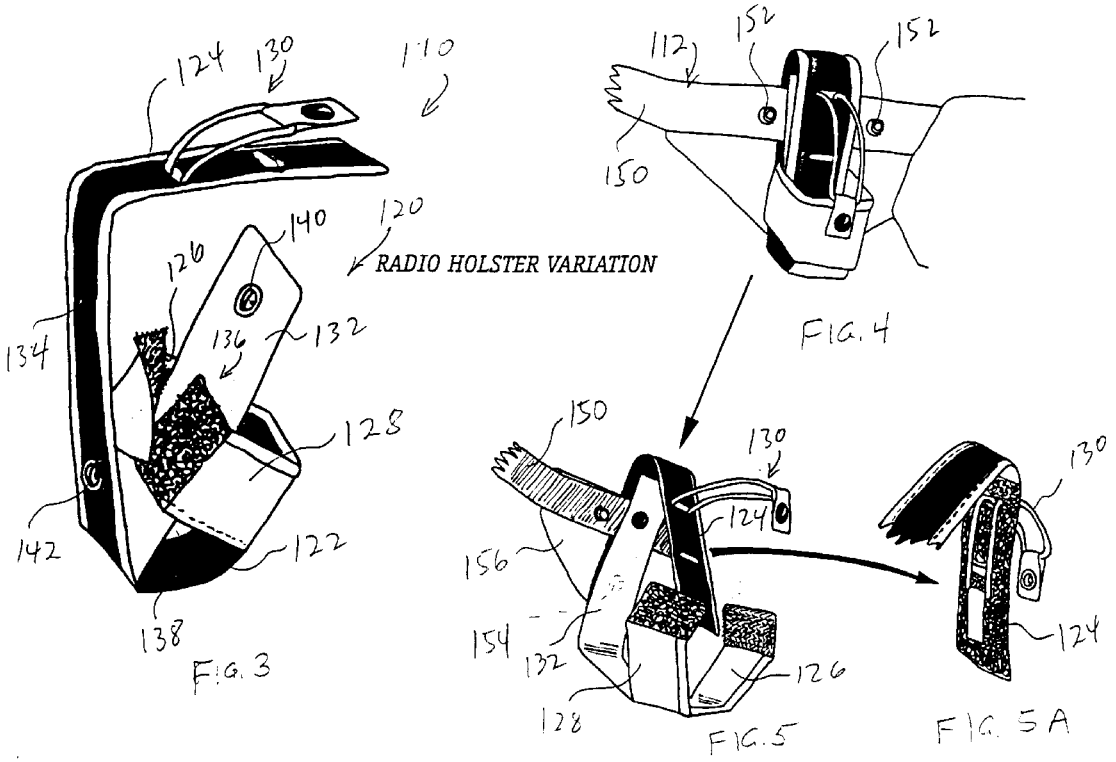
FIG. 3 is a rear, perspective view of a device holster incorporating the adjustable pocket system of FIG. 1.
FIG. 4 is a front, perspective view of the device holster of FIG. 3.
FIG. 5 is a front, perspective view of the device holster of FIG. 3 being adjusted to a different size.
FIG. 5A is a rear, perspective view depicting a portion of the device holster of FIG. 3.

Referring now to FIG. 3, depicted therein is a device holster 110 that incorporates an adjustable pocket system such as the pocket system 20 described above. The device holster 110 is adapted to be mounted onto a belt assembly 112 that will normally be worn about a user's waist.

The device holster 110 comprises a pocket system 120 comprising a front panel 122, rear panel 124, first and second side panels 126 and 128, a strap assembly 130, a backing panel 132, and a belt panel 134. As shown in FIG. 3, certain of these panels may be formed of a single piece of material while others are sown together into the device holster 110.

The pocket system 120 of the device holder 110 functions in the same basic manner as the pocket system 20 described above. The pocket system 120 will thus be described only to the extent that it differs in construction and operation from the system 20.

The side panels 126 and 128 of the system 120 have, at their inner ends, a hook and loop fastener 136 that allows the front to back dimensions of a pocket chamber 138 defined by the system 120 to be adjusted. Formed on the backing panel 132 is a portion 140 of a button system the purpose of which will be described in further detail below. Formed on the belt panel 134 is another button portion 142 that will be described in further detail below.

In use, a belt strap 150 is passed between the belt panel 134 and the backing panel 136. The rear panel 124 is folded over parallel to the belt panel 134 such that the backing panel 132 is arranged between the front panel 124 and the belt panel 134. Three button portions 152 (only two shown in FIG. 4) are formed on the belt strap 150; these button portions are adapted to engage the button portion 140 described above to adjust an angle at which the device holster 110 extends relative to the belt strap 150.

A button portion 154 (FIG. 5) is formed on a bib portion 156 that extends downwardly from the belt strap 150. This button portion 154 is adapted to engage the button portion 142 on the belt panel 134. The engagement of the button portions 154 and 142 allows the device holder 110 to pivot, with the button portions 140 and 152 locking the device holder 110 into one of three angles relative to the belt strap 150.

FIG. 4 depicts the device holster 110 when the button are attached such that it extends it substantially a right angle to the belt strap 150. FIG. 5 shows how the device holster 110 may be disassembled to reconfigure the location of the strap assembly 130 as described above with reference to the pocket system 20. In particular, the fastening system 136 that attaches the side straps 128 and 126 together is opened and the rear panel 124 is rotated away from the backing panel 132. As shown in FIG. 5A, in this configuration the back of the rear panel 124 is exposed to allow the strap assembly 130 to be adjusted, as described above, to accommodate electronic devices of different sizes and dimensions. Once this adjustment is accomplished, the rear panel 124 is rotated back against the backing panel 132 and the side panels 126 and 128 are connected together using the hook and loop fastener 136.

III. Device Chest Harness

Figure 6:
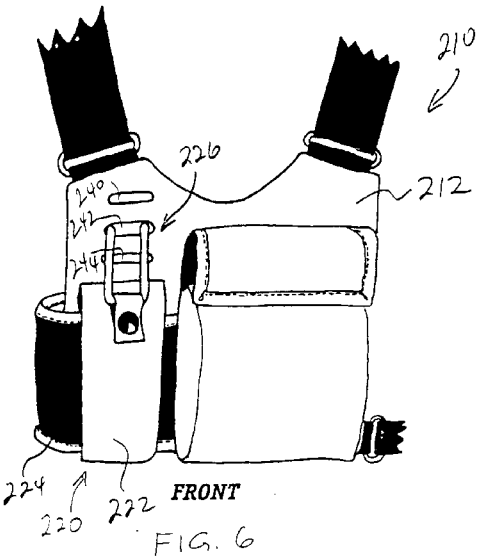
FIG. 6 is a front elevation view of a device chest harness incorporating the adjustable pocket system of FIG. 1.

Referring now to FIG. 6, depicted therein is a device chest harness 210 that incorporates an adjustable pocket system such as the pocket system 20 described above.

The device chest harness 210 is in most other respects conventional and will be described herein only to the extent necessary for complete understanding of the present invention.

In particular, the chest harness 210 comprises a chest panel 212 that is configured and dimensioned to fit against the wearer's chest. Additionally, this panel 212 performs the function of the rear panel 26 of the adjustable pocket system 20 described above.

The device chest harness 210 comprises an adjustable pocket system 220 that is located to the front of one side of the chest panel 212. This pocket system 220 comprises, in addition to a portion of the chest panel 212, a front panel 222, a side panel strap 224, and a strap assembly 226. The side strap member 224 forms side panels 230 and 232, and its end forms the backing panel 234.

Figure 7:
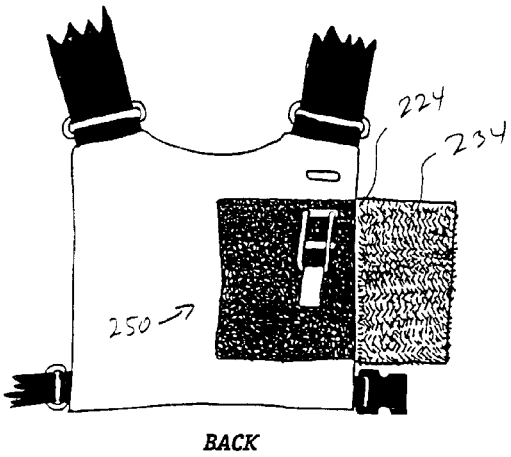
FIG. 7 is a rear elevation partial section view of the device chest harness of FIG. 6.
Figure 8:
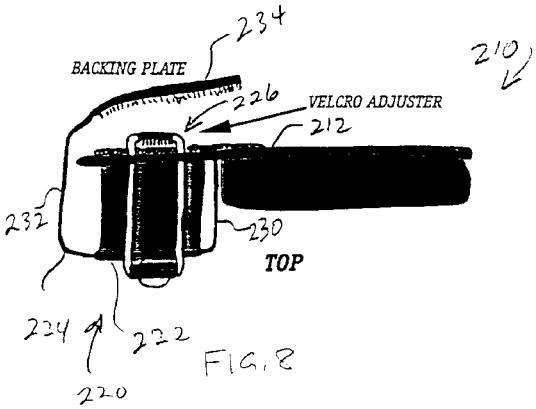
FIG. 8 is a top plan view of a portion of the device chest harness of FIG.6.
Figure 9:
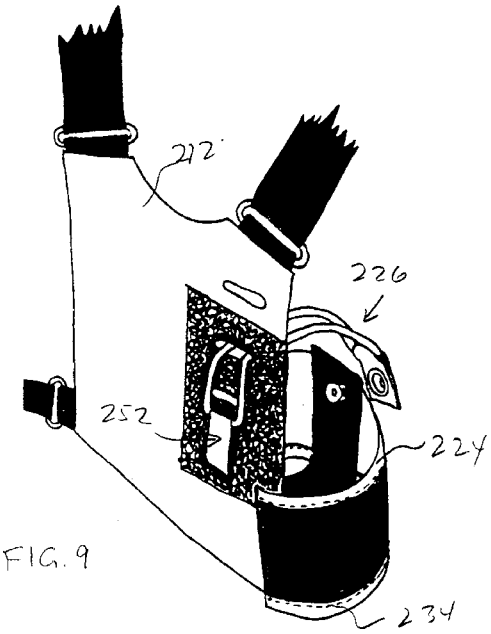
FIG. 9 is a rear perspective partial section view of the device chest harness of FIG. 6.

Again, the adjustable pocket system 220 operates in the same basic fashion of the pocket system 20 described above. The strap assembly 226 extends through one of a plurality of strap openings 240, 242, and 244 as is appropriate for the electronic device being carried. As shown in FIGS. 7 and 9, the backing panel portion 234 of the side strap 224 employs a hook and loop fastener system 250 to allow the backing panel 234 to be detachably attached to the rear surface of the chest panel 212. An inner end 252 of the strap assembly 226 also has an appropriate hook loop fastener portion formed thereon such that it too may be detachably attached to the back surface of the chest panel 212.

Again, the effective length of the strap assembly 226 may be adjusted as appropriate for a given portable electronic device to be carried by the pocket system 220. Also, the backing panel portion 234 of the side strap member 224 may be attached to the chest panel 212 to shorten and lengthen the side panels 230 and 232 as is appropriate for the selected electronic device.

IV. Summary

From the foregoing, it should be apparent that the adjustable pocket system 20 of the present invention may be applied to a number of systems in which portable electronic devices of unknown and various physical dimensions may be carried. The scope of the present invention should thus be determined based on the claims attached hereto and not the foregoing detailed description.

What is claimed is:

1. An adjustable pocket comprising:

a pocket chamber adapted to contain equipment, where the pocket chamber is defined by a front wall, a rear wall having at least one hole formed therein, a bottom wall, a first side wall, and a second side wall; and a strap assembly comprising a strap member having first and second ends, a first fastener for fastening the strap member first end to the front wall, and a second fastener for fastening the strap member second end to one of a plurality of locations on an outer surface of the rear wall; whereby the strap member extends through the at least one hole in the rear wall such that the second fastener fastens the strap member second end to a selected one of the plurality of locations on the outer surface of the rear wall corresponding to a desired form factor defined by the adjustable pocket.

2. An adjustable pocket as recited in claim 1, in which the second fastener is a hook and loop fastener.

3. An adjustable pocket as recited in claim 1, in which a plurality of holes are formed in the rear wall, where the strap member extends through a selected one of the plurality of holes depending on the desired form factor defined by the adjustable pocket.

4. An adjustable pocket as recited in claim 1, further comprising a belt panel, where the belt panel is arranged behind the rear wall and is adapted to allow the adjustable pocket to be suspended from a belt.

5. An adjustable pocket as recited in claim 1, in which the back wall is formed on a chest panel of a chest harness.

6. An adjustable pocket as recited in claim 1, further comprising a backing panel that covers the second fastener.

7. An adjustable pocket as recited in claim 6, further comprising a belt panel, where the backing panel is arranged between the rear wall and the belt panel and the belt panel is adapted to allow the adjustable pocket to be suspended from a belt.

8. An adjustable pocket as recited in claim 1, in which the strap assembly further comprises an inner panel attached to the second end of the strap member, where the second fastener fastens the inner panel to the rear wall.

9. An adjustable pocket as recited in claim 8, in which the second fastener is a hook and loop fastener, and one of a hook portion and a loop portion of the hook and loop fastener is formed on the inner panel.

10. An adjustable pocket as recited in claim 9, in which one of the hook portion and the loop portion is formed on the rear wall.

11. An adjustable pocket comprising:

a pocket chamber adapted to contain equipment, where the pocket chamber is defined by a front wall, a rear wall having at least one hole formed therein, a bottom wall, a first side wall, and a second side wall; and a strap assembly comprising a strap member having first and second ends, a snap fastener for fastening the strap member first end to the front wall, an inner panel attached to the second end of the strap member, and a hook and loop fastener for fastening the inner panel to the rear wall; whereby the strap member extends through the at least one hole in the rear wall such that the hook and loop fastener fastens the strap member second end to an outer surface of the rear wall.

12. An adjustable pocket as recited in claim 11, in which a plurality of holes are formed in the rear wall, where the strap member extends through a selected one of the plurality of holes depending a desired form factor defined by the adjustable pocket.

13. An adjustable pocket as recited in claim 11, further comprising a belt panel, where the belt panel is arranged behind the rear wall and is adapted to allow the adjustable pocket to be suspended from a belt.

14. An adjustable pocket as recited in claim 11, in which the back wall is formed on a chest panel of a chest harness.

15. An adjustable pocket as recited in claim 11, further comprising a backing panel that covers the hook and loop fastener.

16. An adjustable pocket as recited in claim 15, further comprising a belt panel, where the backing panel is arranged between the rear wall and the belt panel and the belt panel is adapted to allow the adjustable pocket to be suspended from a belt.

17. An adjustable pocket comprising:

a pocket chamber adapted to contain equipment, where the pocket chamber is defined by a front wall, a rear wall having at least one hole formed therein, a bottom wall, a first side wall, and a second side wall; and a strap assembly comprising a strap member having first and second ends, a first fastener for fastening the strap member first end to the front wall, and a second fastener for fastening the strap member second end to the rear wall, where the second fastener is a hook and loop fastener; whereby the strap member extends through the at least one hole in the rear wall such that the second fastener fastens the strap member second end to an outer surface of the rear wall.

18. An adjustable pocket as recited in claim 17, in which a plurality of holes are formed in the rear wall, where the strap member extends through a selected one of the plurality of holes depending a desired form factor defined by the adjustable pocket.

19. An adjustable pocket as recited in claim 17, further comprising a belt panel, where the belt panel is arranged behind the rear wall and is adapted to allow the adjustable pocket to be suspended from a belt.

20. An adjustable pocket as recited in claim 17, in which the back wall is formed on a chest panel of a chest harness.

21. An adjustable pocket as recited in claim 17, further comprising a backing panel that covers the second fastener.

22. An adjustable pocket as recited in claim 21, further comprising a belt panel, where the backing panel is arranged between the rear wall and the belt panel and the belt panel is adapted to allow the adjustable pocket to be suspended from a belt.

23. An adjustable pocket as recited in claim 17, in which the strap assembly further comprises an inner panel attached to the second end of the strap member, where the second fastener fastens the inner panel to the rear wall.

24. An adjustable pocket as recited in claim 23, in which one of a hook portion and a loop portion of the hook and loop fastener is formed on the inner panel.

25. An adjustable pocket as recited in claim 24, in which one of the hook portion and the loop portion is formed on the rear wall.

26. An adjustable pocket comprising:

a pocket chamber adapted to contain equipment, where the pocket chamber is defined by a front wall, a rear wall having at least one hole formed therein, a bottom wall, a first side wall, and a second side wall;

a strap assembly comprising a strap member having first and second ends, a first fastener for fastening the strap member first end to the front wall, and a second fastener for fastening the strap member second end to the rear wall; and a backing panel that covers the second fastener; whereby the strap member extends through the at least one hole in the rear wall such that the second fastener fastens the strap member second end to an outer surface of the rear wall.

27. An adjustable pocket as recited in claim 26, in which the second fastener is a hook and loop fastener.

28. An adjustable pocket as recited in claim 26, in which a plurality of holes are formed in the rear wall, where the strap member extends through a selected one of the plurality of holes depending a desired form factor defined by the adjustable pocket.

29. An adjustable pocket as recited in claim 26, further comprising a belt panel, where the belt panel is arranged behind the rear wall and is adapted to allow the adjustable pocket to be suspended from a belt.

30. An adjustable pocket as recited in claim 26, further comprising a belt panel, where the backing panel is arranged between the rear wall and the belt panel and the belt panel is adapted to allow the adjustable pocket to be suspended from a belt.

31. An adjustable pocket as recited in claim 26, in which the back wall is formed on a chest panel of a chest harness.

32. An adjustable pocket as recited in claim 26, in which the strap assembly further comprises an inner panel attached to the second end of the strap member, where the second fastener fastens the inner panel to the rear wall.

33. An adjustable pocket as recited in claim 32, in which the second fastener is a hook and loop fastener, and one of a hook portion and a loop portion of the hook and loop fastener is formed on the inner panel.

34. An adjustable pocket as recited in claim 33, in which one of the hook portion and the loop portion is formed on the rear wall.

35. A method of forming an adjustable pocket comprising the steps of:

providing a front wall, a rear wall having at least one hole formed therein, a bottom wall, a first side wall, and a second side wall;

arranging the front wall, rear wall, bottom wall, first side wall, and second side wall to define a pocket chamber;

providing a strap assembly comprising a strap member having first and second ends, a first fastener, and a second fastener;

extending the strap member through the at least one hole in the rear wall such that the second fastener fastens the strap member second end to an outer surface of the rear wall to define a first form factor;

operating the first fastener to fasten the strap member first end to the front wall; and adjusting a location at which the second fastener fastens the strap member second end to the outer surface of the rear wall to define a second form factor.

36. A method as recited in claim 35, further comprising the steps of:

forming a plurality of holes in the rear wall; and extending the strap member through a selected one of the plurality of holes to define a second form factor.

37. A method as recited in claim 35, further comprising the step of covering the second fastener with a backing panel.

38. A method of forming an adjustable pocket comprising the steps of:

providing a front wall, a rear wall having at least one hole formed therein, a bottom wall, a first side wall, and a second side wall;

arranging the front wall, rear wall, bottom wall, first side wall, and second side wall to define a pocket chamber;

providing a strap assembly comprising a strap member having first and second ends, a first fastener, and a second fastener;

extending the strap member through the at least one hole in the rear wall such that the second fastener fastens the strap member second end to an outer surface of the rear wall to define a first form factor;

operating the first fastener to fasten the strap member first end to the front wall; and covering the second fastener with a backing panel.

39. A method as recited in claim 38, further comprising the steps of:

forming a plurality of holes in the rear wall; and extending the strap member through a selected one of the plurality of holes to define a second form factor.

* * * * *